United States Patent [19]

Hatayama

[11] 4,325,003

[45] Apr. 13, 1982

[54] MAGNETRON

[75] Inventor: Suinchi Hatayama, Mobara, Japan

[73] Assignee: Hitachi, Ltd., Tokyo, Japan

[21] Appl. No.: 125,695

[22] Filed: Feb. 28, 1980

[30] Foreign Application Priority Data

May 11, 1979 [JP] Japan ..... 54-62044[U]

[51] Int. Cl.[3] ..... H01J 25/50

[52] U.S. Cl. ..... 315/39.51; 315/39.75

[58] Field of Search ..... 315/39.51, 39.71, 39.75, 315/39.53

[56] References Cited

U.S. PATENT DOCUMENTS

| | | | |
|---|---|---|---|
| 3,967,087 | 6/1976 | Kanuma | 315/39.51 |
| 3,989,979 | 11/1976 | Konno et al. | 315/39.71 |
| 4,044,279 | 8/1977 | Tsuzurahara et al. | 315/39.71 |
| 4,204,138 | 5/1980 | Koinuma et al. | 315/39.51 |
| 4,205,256 | 5/1980 | Oguro | 315/39.51 |
| 4,207,496 | 6/1980 | Nakai | 315/39.51 |

*Primary Examiner*—Saxfield Chatmon, Jr.
*Attorney, Agent, or Firm*—Charles E. Pfund

[57] ABSTRACT

In a magnetron, a metal gasket for shielding leakage of high frequency energy generated in the magnetron is inserted in a space define by the yoke, magnetic pole piece and sealing metal member. A retainer is provided on a portion of the yoke which is in contact with the gasket, for preventing the gasket from falling off.

4 Claims, 5 Drawing Figures

MAGNETRON

BACKGROUND OF THE INVENTION

This invention relates to a magnetron and more particularly to a structure for fixing a gasket which shields leakage of the high frequency output.

Generally, the magnetron is incorporated in electronic ovens or defrosters and widely used for heating or defrosting foodstuffs since it efficiently generates high frequency energy.

FIG. 1 shows, in schematic sectional view, a typical, conventional magnetron. In the figure, reference numeral 1 denotes an anode cylinder made of, for instance, oxygen-free copper with a plurality of radial vanes 2 fixed on the inner wall thereof. The anode cylinder 1 and the vanes 2 constitute an anode electrode of the magnetron. Reference numerals 4 and 5 denote conical pole pieces fixed at the upper and lower ends of the anode cylinder 1. A sealing member 6 in the form of a cup is fixed by, for instance, soldering to the upper surface of the magnetic pole piece 4 and an insulating member 7 is provided above the sealing member. On the central axis of the anode electrode 3, there is provided a thermionic emission type cathode electrode 8 of, for instance, coiled thorium tungsten in a space surrounded by the free end portions of the plural vanes 2, defining a so-called interaction space 9 between the cathode electrode 8 and the tips of the vanes 2. Reference numerals 10 and 11 denote end shields provided at both ends of the cathode electrode 8 respectively, for preventing electrons from deviating axially.

Reference numerals 12*a* and 12*b* denote side supports, 12*c* a center support. These supports pass through the insulating member 7 with one end supported thereby. Secured to the other end of the supports is the cathode electrode 8. Heating current is supplied to the cathode electrode 8 through these supports. Reference numerals 13*a* through 13*c* denote sealing members through which the supports 12*a* through 12*c* are air-tightly fixed to the insulating member 7, and 14 an insulating spacer. The insulating spacer 14, through which the supports 12*a* to 12*c* pass, serves to prevent vibratory motion of the supports and to correct the location of the cathode electrode 8. Reference numeral 15 denotes a sealing metal member fixed to the magnetic pole piece 5, and 16 an insulating dome which extends from the sealing metal member 15. An antenna 17 in the form of a metal rod connected, at one end, to the vane 2 is inserted in the dome 16. The antenna 17 serves to pick up high frequency energy and deliver it to the outside. Reference numerals 18 and 19 respectively denote permanent magnets, 20 and 21 yokes to introduce the magnetic field produced by the permanent magnets 18 and 19 into the interaction space 9, and 22 and 23 external lead wires connected to the supports 12*a* and 12*c*. To the tip of the lead wire 22 is connected an L-C filter circuit comprising a high-voltage capacitor 27 and a coil 26 which is wound on a ferrite core 24 through, for instance, an adhesive 25 of silicon rubber group. Thus, the input terminal of the magnetron and the L-C filter circuit are enclosed with a filter case 28 and shielded against high frequency.

Reference numeral 29 denotes a metal gasket inserted in a annular space defined by the sealing metal member 15, the yoke 21 and the end surface of the magnetic pole piece 5. The gasket 29 generally takes the form of a ring which is formed by weaving a mesh of stainless steel wire, brass wire or the like with excellent elasticity and electrical conductivity. The metal gasket 29 is urged against the input end portion of a wave guide (not shown) when the magnetron is incorporated into an electronic oven so as to prevent high frequency wave from leaking from the antenna 17 to the outside of the wave guide.

In operation, when a predetermined operating current is supplied between the lead wires 22 and 23 to heat the cathode electrode 8 and a predetermined voltage is supplied to the anode 3, the magnetron starts to oscillate at high frequency and the high frequency energy is radiated into, for instance, an electronic oven through the antenna 17 and the wave guide.

However, in the magnetron of such a conventional structure, the metal gasket 29 inserted in the annular space defined by the sealing metal member 15, the yoke 21 and the pole piece 5 is usually held in the annular space by elasticity of its own and frictional force until the input end portion of the wave guide (partly illustrated at phantom lines in FIG. 2) is connected to the yoke 21 as shown in FIG. 2. However, since the metal gasket has an extremely low dimensional precision due to the fact that it is formed by weaving metal wires and since the sealing metal member 15 and the yoke 21 which define the annular space often deform during pressing work, it is extremely difficult to stably hold the gasket 29 in the annular space. Accordingly, the gasket tends to fall off when the magnetron is being transported or mounted. When the magnetron is deprived of the gasket, there occur leakage and radiation of high frequency energy through the annular space, which is hazardous to human body, a cause for radio interference or sparks in the output unit of the magnetron which may break down the magnetron, so that the reliability of the magnetron is drastically lowered.

SUMMARY OF THE INVENTION

Accordingly, the present invention aims at eliminating the prior art drawbacks and has for its object to provide a highly reliable magnetron by eliminating the falling-off of the metal gasket.

In order to achieve the above object, the magnetron according to the present invention is featured by provision of a retainer on a portion of the yoke which is in contact with the gasket whereby the gasket can be prevented from falling off.

DESCRIPTION OF THE PREFERRED EMBODIMENTS

Figure 1:
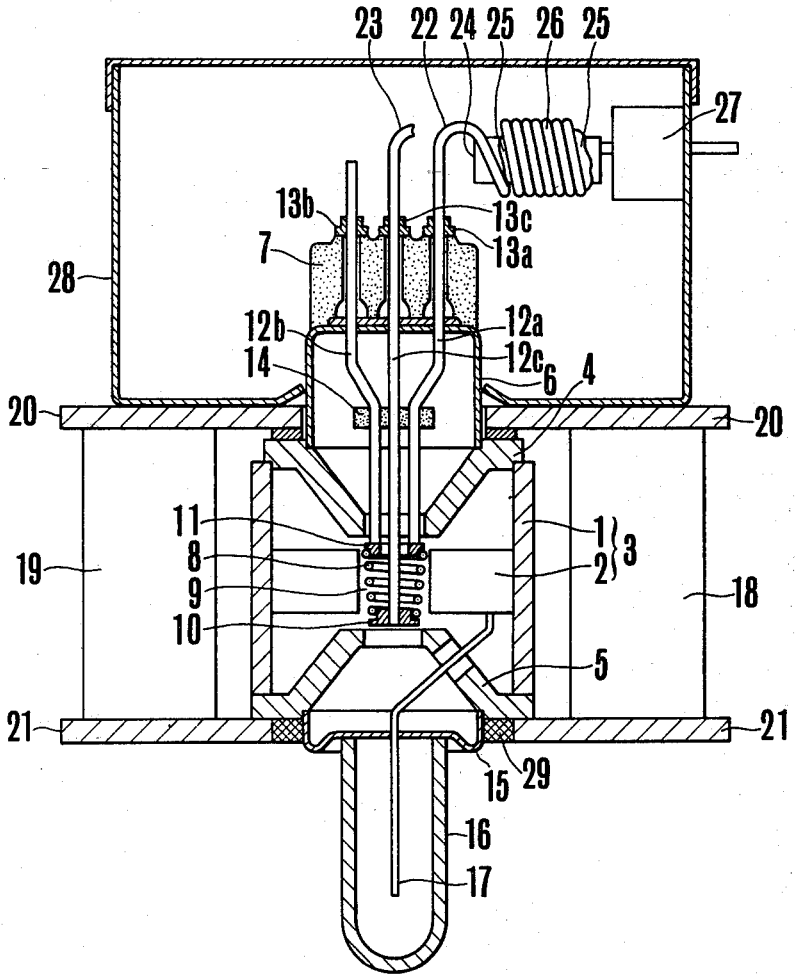
FIG.1 PRIOR ART
FIG. 1 is a schematic sectional view to show a prior art magnetron.
Figure 2:
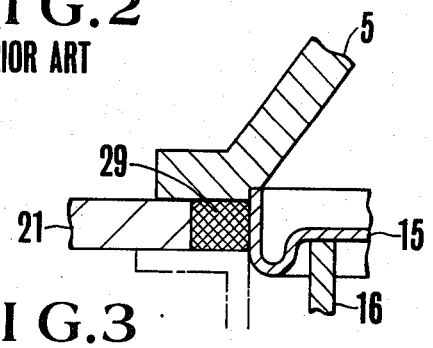
FIG.2 PRIOR ART
FIG. 2 is a fragmentary sectional view to show a mount structure for a gasket in the magnetron of FIG. 1.
Figure 3:
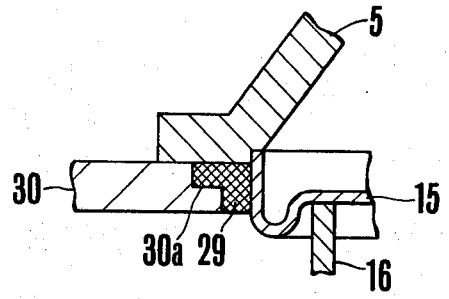
FIGS. 3 to 5 are fragmentary sectional views to show gasket mount structures embodying the present invention.

FIG. 3 is a sectional view showing main parts of an embodiment of the magnetron according to the present invention wherein, since the same parts are denoted by the same reference numerals as in FIG. 1, explanation thereof is omitted. A yoke 30 has a central hole for receiving therein gasket 29 and sealing metal member 15. The wall of the central hole is, as shown in FIG. 3, in contact with the gasket 29. In accordance with the embodiment of FIG. 3, in a portion of the yoke 30, contacting the gasket 29, there is provided a shoulder 30*a* being contiguous to the wall of the central hole and facing the interior of the magnetron so that the central hole has a larger diameter on the side facing the magnetic pole piece 5 than that facing the outside of the magnetron. The shoulder 30*a* acts as a retainer to hold the gasket 29 inserted in the annular space.

In such a construction as above, the shoulder 30*a* of the yoke 30 holds the gasket 29 by pressing the same to positively prevent the gasket from falling off. In such a construction, since the dimensional precision of the outer diameter of the gasket can be allowed to vary to a certain extent, the manufacturing cost of the gasket 29 becomes inexpensive.

Figure 4:
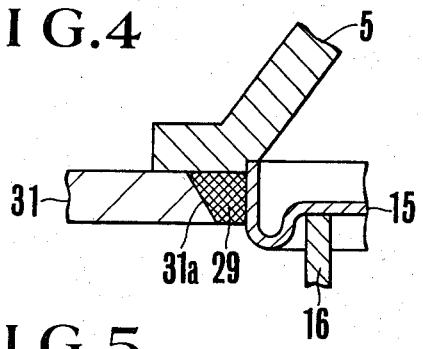

FIG. 4 is a sectional view showing another embodiment of the magnetron of this invention. In the figure there is provided on a portion of a yoke 31 contacting the gasket 29 a slope 31*a* tapered from interior to exterior of the magnetron so that the central hole has a larger diameter on the side facing magnetic pole piece 5 than that facing the exterior. The slope 31*a* serves as a retainer to hold the gasket 29 which can positively prevent the gasket 29 from falling off. In this case, the dimensional precision of the outer diameter of the gasket 29 can also be allowed to vary to a certain extent, thereby reducing the manufacturing cost. Further, the slope is more easy to machine than the shoulder in the embodiment of FIG. 3.

Figure 5:
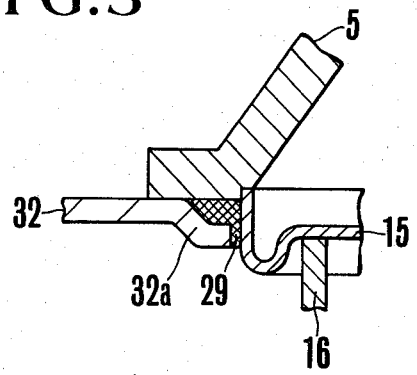

FIG. 5 is a sectional view of still another embodiment of the magnetron according to the present invention. In the figure there is provided on a portion of yoke 32 contacting the gasket 29 an annular bent member 32*a* which is bent outwardly to form a recess facing the interior. Obviously, this bent member 32*a* serves as a retainer to hold the gasket which can prevent the gasket from falling off, achieving the same effect as the above embodiments. In such a construction, the thickness of the gasket 29 may be reduced, allowing the reduction of the thickness of the yoke 32 and thus, the amount of material and the cost of manufacturing can be cut down.

As has been described in the foregoing, the present invention can positively prevent the gasket from falling off and completely eliminate the leakage of high frequency energy, hazardous affect of radiation on human health, radio interference and break down of the magnetron, thereby greatly improving reliability of the magnetron.

What is claimed is:

1. In a magnetron comprising an anode having a plurality of vanes provided radially around a cathode, a magnetic pole piece provided at an output terminal portion of the anode to guide flux of a permanent magnet to the center of the anode, whereby high frequency wave is generated in an interaction space between the anode and the vanes, metal means for vacuum sealing arranged in alignment with the center of the magnetic pole piece, a yoke being contiguous to the end surface of the magnetic pole piece and having a central hole which faces the outer circumference of the vacuum sealing metal means to form a magnetic path of the permanent magnet, and a metal gasket surrounding the vacuum sealing metal means for preventing leakage of the high frequency wave, the improvement wherein said yoke has a retainer provided on a portion of said yoke which is in contact with said gasket, and the retainer, magnetic pole piece and vacuum sealing means substantially wrap said gasket to constrain movement in the axial direction thereby, preventing said gasket from falling off.

2. A magnetron according to claim 1 wherein said retainer comprises a shoulder facing the interior of the magnetron.

3. A magnetron according to claim 1 wherein said retainer comprises a slope tapered from interior to exterior of the magnetron.

4. A magnetron according to claim 1 wherein said retainer comprises an annular bent member which is bent outwardly to form a recess facing the interior of the magnetron.

* * * * *